US009597543B2

(12) United States Patent
Kaszer

(10) Patent No.: US 9,597,543 B2
(45) Date of Patent: Mar. 21, 2017

(54) COMBINATION KETTLEBELL AND DUMBBELL WEIGHT

(71) Applicant: Jamie Kaszer, Encinitas, CA (US)

(72) Inventor: Jamie Kaszer, Encinitas, CA (US)

( * ) Notice: Subject to any disclaimer, the term of this patent is extended or adjusted under 35 U.S.C. 154(b) by 0 days.

(21) Appl. No.: 15/043,522

(22) Filed: Feb. 13, 2016

(65) Prior Publication Data

US 2016/0236029 A1 Aug. 18, 2016

Related U.S. Application Data

(60) Provisional application No. 62/117,338, filed on Feb. 17, 2015.

(51) Int. Cl.
*A63B 21/00* (2006.01)
*A63B 21/072* (2006.01)
*A63B 21/075* (2006.01)

(52) U.S. Cl.
CPC ..... *A63B 21/0726* (2013.01); *A63B 21/072* (2013.01); *A63B 21/075* (2013.01); *A63B 21/4035* (2015.10)

(58) Field of Classification Search
CPC ..... A63B 21/072–21/0728
See application file for complete search history.

(56) References Cited

U.S. PATENT DOCUMENTS 8,684,889 B1 * 4/2014 Berrisford ..... A63B 21/4035 482/107
2011/0111929 A1 * 5/2011 Allison ..... A63B 21/072 482/108
2013/0210589 A1 * 8/2013 Thompson ..... A63B 21/0726 482/108
2013/0274076 A1 * 10/2013 Smith ..... A63B 21/065 482/105
2014/0135186 A1 * 5/2014 Reynolds ..... A63B 21/0726 482/108
2014/0274598 A1 * 9/2014 Anderson ..... A63B 21/0728 482/108
2015/0105224 A1 * 4/2015 Odneal ..... A63B 21/0726 482/107

* cited by examiner

*Primary Examiner* — Loan H Thanh
*Assistant Examiner* — Jennifer M Deichl
(74) *Attorney, Agent, or Firm* — Eric Hanscom; Todd J. Langford

(57) ABSTRACT

A new weight for exercise and physical fitness is disclosed. The invention combines a kettlebell with the dumbbell, so a user can gain the swinging, aerobic benefits of a kettlebell and at the same time utilize the invention as a traditional dumbbell.

20 Claims, 4 Drawing Sheets

COMBINATION KETTLEBELL AND DUMBBELL WEIGHT

CROSS REFERENCE TO RELATED APPLICATIONS

This application claims priority from U.S. Provisional Application No. 62/117,338, filed Feb. 17, 2015, a copy of which is attached to this application and the contents of which are incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general fields of physical fitness gear, and more specifically toward a combination kettlebell/dumbbell free weight.

Dumbbells have their origins at least as far back as ancient Greece, where a crude dumbbell, the haltere, was used for conditioning as well as for holding in the hands during long jump competitions. The current dumbbell first showed up in the 1600's, where two equal weights were distributed at the ends of a handle. The dumbbell today is the best known free weight, used by millions of physical fitness enthusiasts around the world. The dumbbell as it is used today has two equal weights attached to either end of a handle. The user grips the handle and lifts the weight to exercise.

The kettlebell has its origins in Russia. Kettlebells were originally used as a weight for field crops, and by the 1900's the Russian Army was using kettlebells for exercise and conditioning. The kettlebell appears like a cannon ball to which a handle was attached. As opposed to a dumbbell where the weight is evenly balanced on either side of the user's hand, the kettlebell has the center of weight significantly beyond the hand of user. Thus, while a dumbbell is better for doing curls and other exercises involving and up-and-down movement of the weight, kettlebells are better for swinging exercises and many users feel they provide a better aerobic workout than do dumbbells.

Over the past several years, interest in kettlebells has increased dramatically, in part because many physical fitness enthusiasts feel that the swinging exercises in which the kettlebell is a superior weight to the dumbbell are more in line with cardiovascular benefits and calisthenics workouts using multiple muscle groups. As such, many gyms, both commercial and those individuals will keep in their homes, have both a dumbbell set and a kettlebell set. This provides a number of problems, including having to purchase and store two sets of weights. From an environmental perspective, a set of dumbbells next to a set of kettlebells represents two separate uses of resources and two sets of pollution from the manufacturing and shipping of each weight set.

Since both dumbbells and kettlebells are generally made from lead or another heavy metal, it would be desirable to provide a new product that provided the fitness benefits of both dumbbells and kettlebells in a single weight unit. The current invention provides a solution to these problems by providing a weight that combines a dumbbell and a kettlebell in a single weight that can be used as either a dumbbell or kettlebell.

BRIEF SUMMARY OF THE INVENTION

The invention comprises a kettlebell with a hole in the center with a handle that a user can grab. The handle is located such that the weight is evenly balanced from side to side, and from front to back, such that it behaves as a dumbbell when grabbed by the central handle. On the other hand, because it has the typical kettlebell handle on the top, it can also be used as a kettlebell.

There are several variations of the basic concept contemplated. First, a kettlebell could be manufactured with a hollow built into its center through which a rod, similar to the rod holding together two weights to make a dumbbell.

Second, a kettlebell could be manufactured with an open bottom portion into which a rod is molded, allowing a user to grab the weight by either the kettlebell top or the dumbbell bottom.

Other embodiments are contemplated where the upper and lower hemispheres are intentionally unbalanced by the placement of the dumbbell handle, and it is also contemplated the adjustable dumbbell handles could be created such that a user would adjust the respective weights of the upper and lower halves of the invention.

SUMMARY OF THE INVENTION

The current invention provides a solution to the problem of having to manufacture, ship, and store a set of dumbbells and a set of kettlebells by having a kettlebell with a cavity in its center with a handle that can be gripped like the handle on a dumbbell.

It is a principal object of the invention to provide a combination kettlebell/dumbbell.

It is another object of the invention to provide physical fitness weight than can provide the exercise benefits of both a kettlebell and a dumbbell in a single item.

It is a final object of this invention to provide a kettlebell with a handle located in the weighted center of the kettlebell such that the handle, which gripped by a user, provides the same balanced feel that a dumbbell provides.

Particular embodiments of the current disclosure provide for an exercise weight comprising a main body and a kettlebell handle, where the kettlebell handle extends outward from the main body, where the kettlebell handle has a grasping portion, where the grasping portion has a longitudinal axis running along its length from end to end; where the main body comprises a cavity, a right side hemisphere, and a left side hemisphere, where the cavity comprises a dumbbell handle extending therethrough, where the dumbbell handle has a longitudinal axis running along its length between the right side hemisphere and the left side hemisphere; where the exercise weight has an equal weight distribution about the longitudinal axis of the dumbbell handle, and where the exercise weight has an equal weight distribution between the right side hemisphere and the left side hemisphere. The longitudinal axis of the dumbbell handle is parallel to the longitudinal axis of the grasping portion of the kettlebell handle. Alternatively, the longitudinal axis of the dumbbell handle is perpendicular to the longitudinal axis of the grasping portion of the kettlebell handle. The longitudinal axis of the dumbbell handle may extend towards and away from the longitudinal axis of the grasping portion of the kettlebell handle. The cavity of the main body extends to a front side and a back side of the main body, whereby the dumbbell handle within the cavity is accessible from the front or back of the main body. The cavity of the main body may also, or in the alternative extend to a bottom of the main body, whereby the dumbbell handle within the cavity is accessible from the bottom of the main body. The main body has a bottom portion with flattened edges, whereby the exercise weight is stable while resting on a flat surface. The exercise weight consists of a single homogenous material.

Further embodiments of the current disclosure provide for a kettlebell exercise weight comprising a handle portion and a main body, where the handle portion is attached to and extends away from the main body, where the main body comprises a cavity and a dumbbell handle extending through the cavity; where the kettlebell exercise weight has a top hemisphere with a mass and a bottom hemisphere with a mass, where the top hemisphere is the portion of the kettlebell exercise weight above the dumbbell handle, where the bottom hemisphere is the portion of the kettlebell exercise weight below the dumbbell handle, where a torque applied about the dumbbell handle by the mass of the top hemisphere is equal to a torque applied about the dumbbell handle by the mass of the bottom hemisphere; and where the kettlebell exercise weight has a right hemisphere with a mass and a left hemisphere with a mass, where the right hemisphere is the portion of the kettlebell exercise weight to the right of the center of the dumbbell handle, where the left hemisphere is the portion of the kettlebell exercise weight to the left of the center of the dumbbell handle, where a torque applied about the dumbbell handle by the mass of the right hemisphere is equal to a torque applied about the dumbbell handle by the mass of the left hemisphere. The cavity of the main body extends to a front side, a back side, and a bottom of the main body, whereby the dumbbell handle within the cavity is accessible from the front, back, or bottom of the main body.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 1:
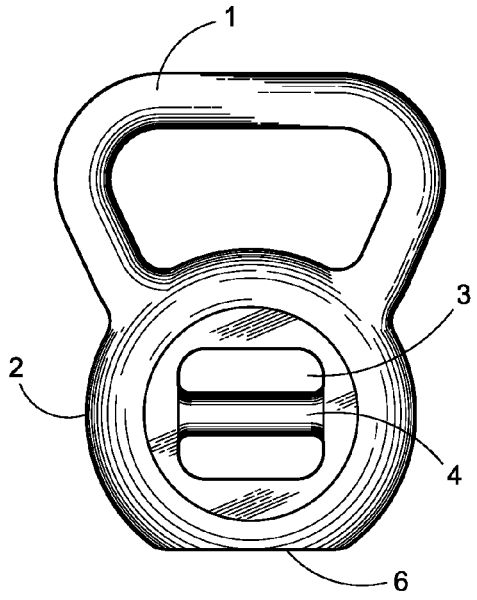
FIG. 1 is a front view of a first embodiment of the invention.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

REFERENCE NUMBER GUIDE

1. Kettlebell handle
2. Kettlebell body
3. Enclosed cavity
4. Dumbbell handle
5. Open cavity
6. Kettlebell bottom

SUMMARY OF INVENTION

The invention provides a kettlebell body, with a kettlebell handle at the top of the kettlebell body, with a cavity at the kettlebell bottom that is bridged by a dumbbell handle. The cavity can be open or closed. In either embodiment, a user can swing the kettlebell handle in a traditional, swinging manner to get the normal exercise benefits as are traditionally associated with kettlebells, but can also grip the dumbbell handle and use the invention like a traditional dumbbell, thereby obtaining the exercise benefits of a dumbbell. The goal of the invention is to provide a single weight that provides users the benefits of both a kettlebell and a dumbbell.

In one embodiment of the invention, the dumbbell handle is located such that the kettlebell top hemisphere—defined as that portion of the kettlebell above the dumbbell handle—is equal in weight to the kettlebell bottom hemisphere—defined as that portion of the kettlebell below the dumbbell handle. Because the kettlebell body and the cavity are symmetrical, the right side hemisphere—defined as that portion of the kettlebell to the right of the center of the dumbbell handle—is equal in weight to the left side hemisphere,—defined as that portion of the kettlebell to the left of the center of the dumbbell handle, are equal in weight. Thus, even though the invention looks very different from a traditional dumbbell, it feels just like a dumbbell because the top and bottom are balanced in weight, as are the sides.

FIG. 1 is a front view of a first embodiment of the invention. The kettlebell handle 1 is attached to kettlebell body 2, allowing a user to swing the kettlebell in a traditional manner. The kettlebell bottom 6 is flattened and allows the invention to rest on the ground in a secure manner. The kettlebell body 2 has a cavity 3, in which a dumbbell handle 4 is location. The user can, as an alternative to grabbing the kettlebell handle and using the invention like a traditional kettlebell, grip the dumbbell handle and use the invention like a traditional dumbbell. The portions of the cavity above and below the dumbbell handle are large enough to accommodate the hand of an average adult.

Figure 2:
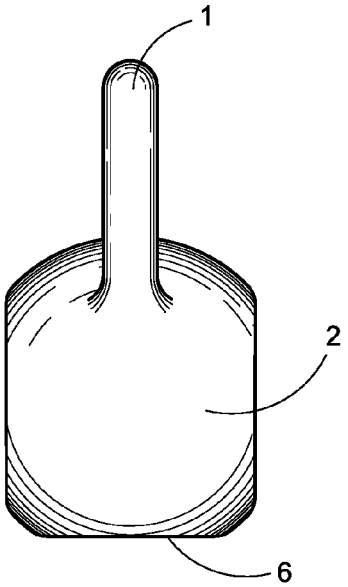
FIG. 2 is a side view of the first embodiment of the invention.

FIG. 2 is a side view of the first embodiment of the invention, showing how even with cavity and dumbbell handle as seen in FIG. 1, the invention still rests on the ground in a secure position similar to a traditional kettlebell as the kettlebell bottom 6 is flat.

Figure 3:
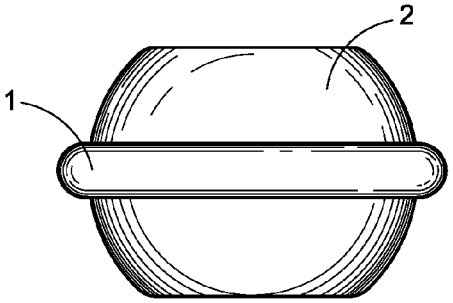
FIG. 3 is a top view of the first embodiment of the invention.

FIG. 3 is a top view of the first embodiment of the invention, showing how even with cavity and dumbbell handle as seen in FIG. 1, the invention still has a kettlebell handle 1 and looks identical to a traditional kettlebell from the top.

Figure 4:
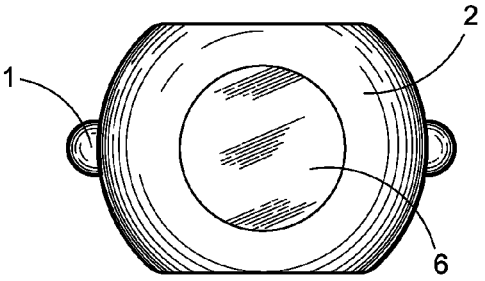
FIG. 4 is a bottom view of the first embodiment of the invention.

FIG. 4 is a bottom view of the first embodiment of the invention, showing the flattened kettlebell bottom 6 that allows the invention to rest securely on the ground.

Figure 5:
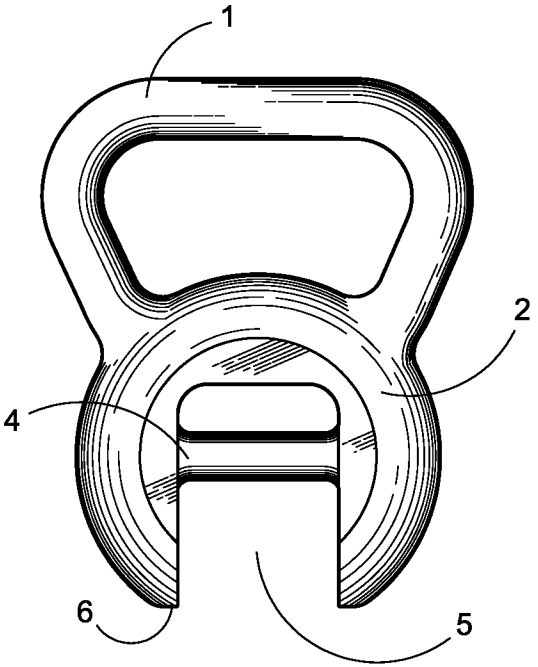
FIG. 5 is a front view of the second embodiment of the invention.

FIG. 5 is a front view of the second embodiment of the invention. In this second embodiment, the kettlebell body 2 still has a kettlebell handle 1 which allows the invention to be used in a traditional manner, but the cavity in this case is an open cavity in the bottom portion of the kettlebell. The open cavity 5 in this case extends from the kettlebell bottom 6, which in that case comprises two flattened ridges extending parallel to the cavity on either side of the open cavity. The flattened edges provide a greater surface area for the invention such that it minimizes damage to the floor. Inside the open cavity 5 is a dumbbell handle 5 that, as in the first embodiment, can be gripped by a user of the invention so that the invention can be used like a traditional dumbbell.

Figure 6:
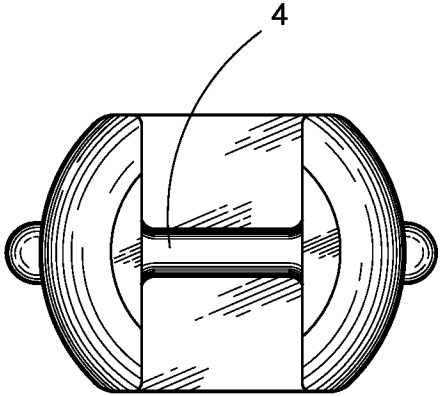
FIG. 6 is a bottom view of the second embodiment of the invention.

FIG. 6 is a bottom view of the second embodiment of the invention, showing how the dumbbell handle 4 is exposed in this embodiment, as opposed the enclosed cavity of the first embodiment in which the dumbbell handle is enclosed, and therefore not visible or reachable from the bottom of the invention.

Figure 7:
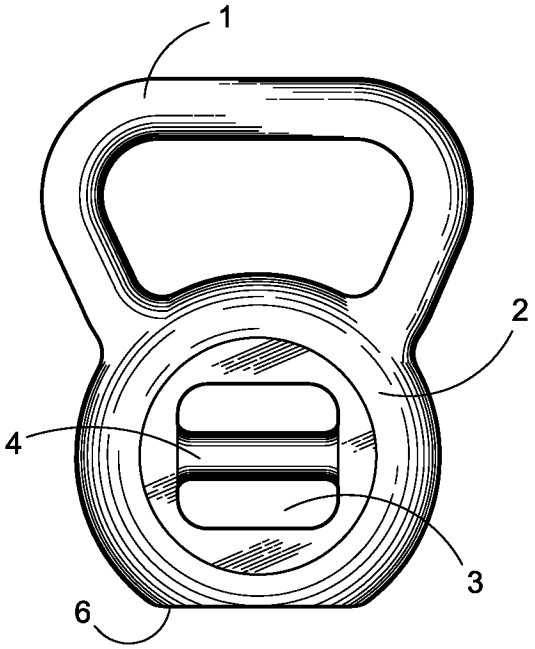
FIG. 7 is a front view of the first embodiment of the invention with the dumbbell handle in the horizontal position.

FIG. 7 is a front view of the first embodiment of the invention with the dumbbell handle 4 in the horizontal position.

Figure 8:
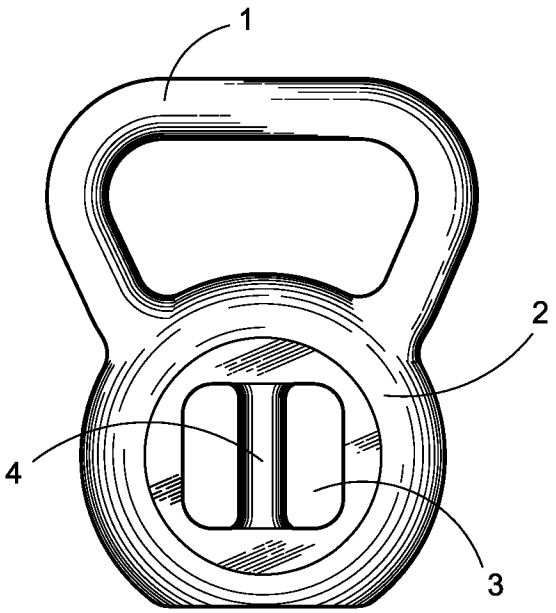
FIG. 8 is a front view of the first embodiment of the invention with the dumbbell handle in the vertical position.

FIG. 8 is a front view of the first embodiment of the invention with the dumbbell handle 4 in the vertical position. It is contemplated that a rotating handle portion could also allow a user to select the angle of the dumbbell handle.

Figure 9:
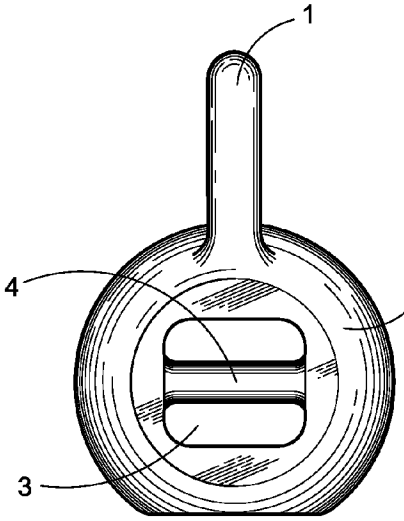
FIG. 9 is a front view of the first embodiment of the invention with the kettlebell handle rotated 90 degrees.

FIG. 9 is a front view of the first embodiment of the invention with the kettlebell handle rotated 90 degrees.

Figure 10:
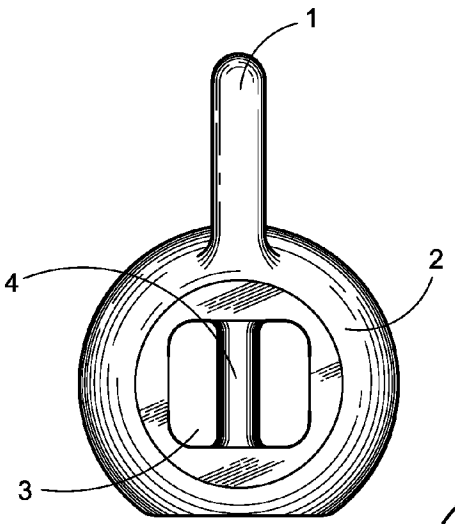
FIG. 10 is a front view of the second embodiment of the invention with the kettlebell handle rotated 90 degrees.

FIG. 10 is a front view of the second embodiment of the invention with the kettlebell handle 1 rotated 90 degrees.

Figure 11:
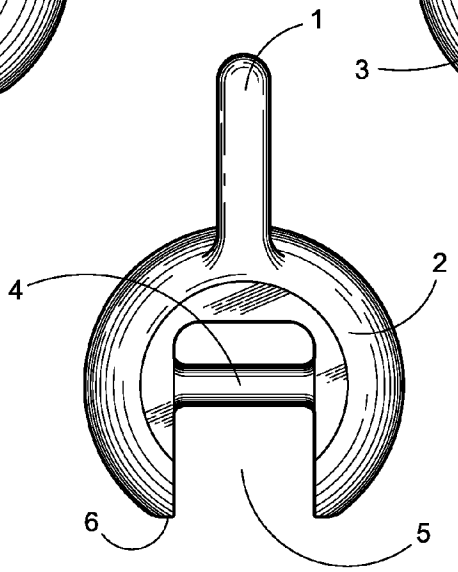
FIG. 11 is a front view of the first embodiment of the invention with the kettlebell handle rotated 90 degrees, and with the dumbbell handle in a vertical position.

FIG. 11 is a front view of the first embodiment of the invention with the kettlebell handle 1 rotated 90 degrees, and with the dumbbell handle 4 in a vertical position.

Figure 12:
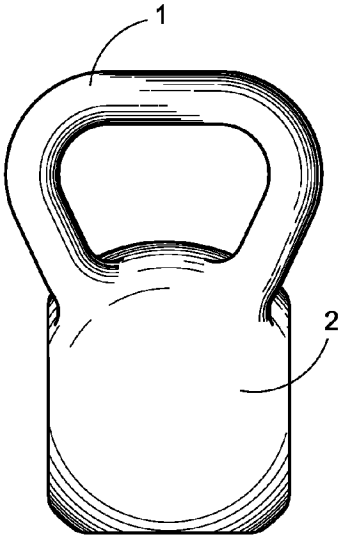
FIG. 12 is a side view of both the first and second embodiment of the invention showing the location of the kettlebell handle when it has been rotated 90 degrees.

FIG. 12 is a side view of both the first and second embodiment of the invention showing the location of the kettlebell handle 1 when it has been rotated 90 degrees.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. An exercise weight, comprising a kettlebell body portion, where the kettlebell body portion comprises a top surface, a bottom surface, a front surface, a back surface, a right-side surface, a left-side surface;

where the exercise weight additionally comprises a kettlebell handle, where the kettlebell handle comprises two upright members connected by a bridge member, thereby forming a hole between the top surface of the kettlebell body and the bridge member, bounded on the sides by the two upright members, where the hole is large enough to accommodate the hand of an average person; and where the kettlebell body portion additionally comprises a cavity, where the cavity has two sides and an upper wall, where the kettlebell body portion additionally comprises a dumbbell handle, where the dumbbell handle is attached to both of the two sides and creates a gap between the dumbbell handle and the upper wall, and where the gap is large enough to accommodate the hand of an average person.

2. The exercise weight of claim 1, where the cavity has a lack of a bottom, such that the sides of the kettlebell body terminate in two points.

3. The exercise weight of claim 2, where the two points each have a blunt bottom surface such that the exercise weight can rest in an upright position.

4. The exercise weight of claim 2, where the dumbbell handle creates a horizontal equator around the kettlebell body, creating an upper hemisphere, where the upper hemisphere comprises that portion of the kettlebell body above the horizontal equator created by the dumbbell handle, and creating a lower hemisphere, where the lower hemisphere comprises that portion of the kettlebell body below the horizontal equator created by the dumbbell handle, and where the upper hemisphere has a weight, and where the lower hemisphere has a weight, and where the weight of the upper hemisphere is roughly equal to the weight of the lower hemisphere.

5. The exercise weight of claim 4, where the kettlebell handle extends away from the top surface of the kettlebell body, where the extension of the kettlebell handle has an effect on the balance of the exercise weight, and where the extension of the kettlebell handle dictates the location of the dumbbell handle in the cavity.

6. The exercise weight of claim 1, where the cavity has a cavity bottom, such that the kettlebell body additionally comprise a bridging bottom section, where the bridging bottom section creates the cavity bottom, where the distance between the cavity bottom and the dumbbell handle is large enough to accommodate the hand of an average person.

7. The exercise weight of claim 6, where the bridging bottom section additionally comprise a blunt bottom surface such that the exercise weight can rest in an upright position.

8. The exercise weight of claim 6, where the dumbbell handle creates a horizontal equator around the kettlebell body, creating an upper hemisphere, where the upper hemisphere comprises that portion of the kettlebell body above the horizontal equator created by the dumbbell handle, and creating a lower hemisphere, where the lower hemisphere comprises that portion of the kettlebell body below the horizontal equator created by the dumbbell handle, and where the upper hemisphere has a weight, and where the lower hemisphere has a weight, and where the weight of the upper hemisphere is roughly equal to the weight of the lower hemisphere.

9. The exercise weight of claim 8, where the kettlebell handle extends away from the top surface of the kettlebell body, where the extension of the kettlebell handle has an effect on the balance of the exercise weight, and where the extension of the kettlebell handle dictates the location of the dumbbell handle in the cavity.

10. An exercise weight comprising a main body and a kettlebell handle, where the kettlebell handle extends outward from the main body, where the kettlebell handle has a grasping portion, where the grasping portion has a longitudinal axis running along its length from end to end;

where the main body comprises a cavity, a right side hemisphere, and a left side hemisphere, where the cavity comprises a dumbbell handle extending therethrough, where the dumbbell handle has a longitudinal axis running along its length between the right side hemisphere and the left side hemisphere;

where the exercise weight has an equal weight distribution about the longitudinal axis of the dumbbell handle, and where the exercise weight has an equal weight distribution between the right side hemisphere and the left side hemisphere;

wherein the cavity of the main body extends to a front side and a back side of the main body, whereby the dumbbell handle within the cavity is accessible from the front or back of the main body.

11. The exercise weight of claim 10, wherein the longitudinal axis of the dumbbell handle is parallel to the longitudinal axis of the grasping portion of the kettlebell handle.

12. The exercise weight of claim 10, wherein the longitudinal axis of the dumbbell handle is perpendicular to the longitudinal axis of the grasping portion of the kettlebell handle.

13. The exercise weight of claim 10, wherein the cavity of the main body further extends to a bottom of the main body, whereby the dumbbell handle within the cavity is accessible from the bottom of the main body.

14. The exercise weight of claim 10, wherein the main body has a bottom portion with flattened edges, whereby the exercise weight is stable while resting on a flat surface.

15. The exercise weight of claim 10, wherein the exercise weight consists of a single homogenous material.

16. A kettlebell exercise weight comprising a handle portion and a main body, where the handle portion is attached to and extends away from the main body, where the main body comprises a cavity and a dumbbell handle extending through the cavity;

where the kettlebell exercise weight has a top hemisphere with a mass and a bottom hemisphere with a mass, where the top hemisphere is the portion of the kettlebell exercise weight above the dumbbell handle, where the bottom hemisphere is the portion of the kettlebell exercise weight below the dumbbell handle, where a torque applied about the dumbbell handle by the mass of the top hemisphere is equal to a torque applied about the dumbbell handle by the mass of the bottom hemisphere; and where the kettlebell exercise weight has a right hemisphere with a mass and a left hemisphere with a mass, where the right hemisphere is the portion of the kettlebell exercise weight to the right of the center of the dumbbell handle, where the left hemisphere is the portion of the kettlebell exercise weight to the left of the center of the dumbbell handle, where a torque applied about the dumbbell handle by the mass of the right hemisphere is equal to a torque applied about the dumbbell handle by the mass of the left hemisphere;

where the cavity of the main body extends to a front side, a back side, and a bottom of the main body, whereby the dumbbell handle within the cavity is accessible from the front, back, or bottom of the main body.

17. An exercise weight comprising a main body and a kettlebell handle, where the kettlebell handle extends outward from the main body, where the kettlebell handle has a grasping portion, where the grasping portion has a longitudinal axis running along its length from end to end;

where the main body comprises a cavity, a right side hemisphere, and a left side hemisphere, where the cavity comprises a dumbbell handle extending therethrough, where the dumbbell handle has a longitudinal axis running along its length between the right side hemisphere and the left side hemisphere;

where the exercise weight has an equal weight distribution about the longitudinal axis of the dumbbell handle, and where the exercise weight has an equal weight distribution between the right side hemisphere and the left side hemisphere;

where the exercise weight consists of a single homogenous material.

18. The exercise weight of claim 17, wherein the longitudinal axis of the dumbbell handle is parallel to the longitudinal axis of the grasping portion of the kettlebell handle.

19. The exercise weight of claim 17, wherein the longitudinal axis of the dumbbell handle is perpendicular to the longitudinal axis of the grasping portion of the kettlebell handle.

20. The exercise weight of claim 17, wherein the main body has a bottom portion with flattened edges, whereby the exercise weight is stable while resting on a flat surface.

* * * * *